US005633647A

United States Patent [19]

Tines

[11] Patent Number: 5,633,647

[45] Date of Patent: *May 27, 1997

[54] BASE SUPPORT FOR MOVABLE ANTENNA

[76] Inventor: John L. Tines, 1 Lakeside Green Dr., St. Louis, Mo. 63124

[ * ] Notice: The term of this patent shall not extend beyond the expiration date of Pat. No. 5,473,335.

[21] Appl. No.: 376,786

[22] Filed: Jan. 23, 1995

Related U.S. Application Data

[63] Continuation-in-part of Ser. No. 180,873, Jan. 11, 1994, Pat. No. 5,473,335.

[51] Int. Cl.[6] ..... H01Q 3/00

[52] U.S. Cl. ..... 343/766; 343/765; 343/757; 343/882

[58] Field of Search ..... 343/765, 766, 343/757, 880, 882; 74/425

[56] References Cited

U.S. PATENT DOCUMENTS

| | | | |
|---|---|---|---|
| 2,464,394 | 3/1949 | Herzlinger | 343/765 |
| 3,495,261 | 2/1970 | Lastinger et al. | 343/709 |
| 3,871,246 | 3/1975 | Craven | 74/425 X |
| 4,040,058 | 8/1977 | Mori et al. | 343/113 |
| 4,126,865 | 11/1978 | Longhurst et al. | 343/766 |
| 4,181,283 | 1/1980 | Rizzo | 343/765 X |
| 4,454,515 | 6/1984 | Major et al. | 343/882 |
| 4,475,110 | 10/1984 | Hutchins | 343/766 |
| 4,609,083 | 9/1986 | Stuhler | 343/765 X |
| 4,617,572 | 10/1986 | Hugo | 343/765 |
| 4,654,670 | 3/1987 | Fleming | 343/765 X |
| 4,790,202 | 12/1988 | Hayashi et al. | 74/425 X |
| 4,827,790 | 5/1989 | Bisiach | 74/425 |
| 4,841,309 | 6/1989 | Burr | 343/766 |
| 4,885,948 | 12/1989 | Thrasher, Jr. et al. | 74/425 X |
| 4,994,815 | 2/1991 | Nakayama | 343/765 |
| 5,023,617 | 6/1991 | Deering | 342/70 |
| 5,038,405 | 8/1991 | Karr | 343/745 X |
| 5,065,969 | 11/1991 | McLean | 343/758 |
| 5,281,975 | 1/1994 | Hugo | 343/766 |
| 5,473,335 | 12/1995 | Tines | 343/766 |

FOREIGN PATENT DOCUMENTS

| | | | |
|---|---|---|---|
| 58-95406 | 7/1983 | Japan . | |
| 1159408 | 11/1989 | Japan . | |
| 3204430 | 9/1991 | Japan . | |
| 468466 | 6/1992 | Japan . | |
| 2051484 | 1/1981 | United Kingdom | H01Q 3/08 |

*Primary Examiner*—Donald T. Hajec
*Assistant Examiner*—Tan Ho
*Attorney, Agent, or Firm*—Polster, Lieder, Woodruff & Lucchesi

[57] ABSTRACT

A base support for a moveable antenna. The base support is attached to an upstanding mounting member and the antenna is attached to a support structure connected to a base member. The support structure is operatively connected to a worm gear assembly which includes a motor driven worm and worm gear disposed between the base member and support structure to effect movement of the antenna about a predetermined axis. The motor driven worm is supported at an outboard end by a first bearing assembly and supported at its opposite end by a pair of spaced apart bearing assemblies to prevent backlash between the motor driven worm and worm gear. A second worm gear assembly including a similarly supported motor driven worn and worm gear can be interposed transversely between the first support structure and a second support structure to effect movement of the antenna about a horizontal axis.

4 Claims, 7 Drawing Sheets

BASE SUPPORT FOR MOVABLE ANTENNA

This application is a continuation-in-part of application Ser. No. 08/180,873, filed Jan. 11, 1994, now U.S. Pat. No. 5,473,335.

BACKGROUND OF THE INVENTION

This invention relates to base support or mounting assemblies for movable antenna, more particularly to stepping motor driven supports for the horizontal and vertical rotation of dish antenna for audio, video or data signals.

It is well known that a satellite antenna may be mounted on a support having relatively movable parts which allow the antenna to be aimed toward a particular satellite in geostationary orbit about the earth to collect signals relayed and/or transmitted from that satellite. A description of the general operation of dish antenna and the relationship thereof to orbiting satellites beaming signals to such antenna is contained in U.S. Pat. No. 4,617,572, issued Oct. 14, 1986, the disclosure of which is incorporated herein by reference thereto.

As described in U.S. Pat. No. 5,281,975, it is known to provide a base support for a dish antenna having manual adjusting means to adjust the position of the antenna along a predetermined plane to direct the antenna toward the "Clark belt" or "geostationary satellite belt". Thereafter, second adjustment means on the base support, including a reversible motor, may be used to scan back and forth along the satellite belt until desired signals from a particular satellite are clearly being received by the dish antenna.

According to U.S. Pat. 5,281,975, and as clearly shown in FIGS. 1–5 thereof, the reversible electric motor M drives a worm 62 which is in intermeshing contact of a worm gear 30. The motor M is mounted stationary in the horizontal plane, while revolution of worm 62 will cause worm gear 30 to move in a horizontal plane i.e. about a vertical axis, thereby repositioning the attached dish antenna.

In the aforestated systems, the worm is actuated by a DC motor driven by a power source. To move the assembly incrementally, the DC motor sends back a pulse count to a controller by means of a high to low voltage signal, such as a twelve (12) to 36 (thirty-six) volts being the high voltage end 0 (zero) to 1 (one) being low voltage. This change in voltage is a count pulse and is accomplished, generally, by opening and closing a switch in a fixed power supply source. The switch may be magnetic, mechanical, or solid state.

The controller operates until it receives a predetermined count and then shuts down. The count speed is predetermined by the rotational speed of the unit. The rotational speed of the unit is determined by the voltage and the load on the motor. This type of feedback control does not allow for particularly fine increments of movement. This is a problem on small or miniature antenna assemblies, for example mobile mounted antenna, which require fine positional adjustments relative to the change in position of the antenna-bearing mobile unit.

It will be appreciated that worm gear drives have two forces working in the system. There are axial forces along the axis of the drive worm and radial forces which tend to push the drive worm out of the worm gear. In a worm driven satellite antenna mount, zero backlash is required since the satellites are positioned at two degree (2°) spacing. The movement of the antenna due to backlash between the worm and worm gear would cause a loss of signal strength which weakens the reception or can cause a complete loss of reception. For example, on a 30 tooth worm gear each tooth represents twelve degrees (12°) of rotation. At a pitch diameter of 1.25 inches, one tooth is the circumference divided by 30 or 3.927 inches divided by 30 or 1.309 inches. One degree of rotation of the antenna is 0.1309 divided by 12 or 0.0109 inches. A 10% error of movement ins 0.0011 inches of movement on the circumference or 1% of a tooth. Such movement occurs when the worm drive moves away from the worm gear or by the worm drive moving axially.

SUMMARY OF THE INVENTION

It is, therefore a principal object of the present invention to provide an antenna mount having a motor drive and driver system for the rotation of an antenna mount which can move the antenna in small increments to provide fine horizontal rotational movements 360° about a predetermined axis.

It is another object of the present invention to provide an antenna mount having a second motor and control system that provide fine incremental movements of an antenna about a horizontal axis for fine vertical adjustment of the attached antenna.

Another object of the present invention is to provide a unit that does not require a feedback signal to a controller.

Yet another object of the present invention is to provide a unit that does not require electrical switches in its motor drive system to protect the antenna from mechanical damage.

Still another object of the present invention is to provide an antenna mount employing a stepping motor and stepping motor driver to provide fine incremental movement of the antenna about a predetermined axis.

A further object of the invention is to provide an antenna mount wherein the speed of horizontal and vertical movement of the antenna is determined by a preset rate of pulses sent from the respective stepping motor driver to the respective stepping motors.

It is another object of the present invention to provide a unit that does not have any backlash between the worm and worm gear.

In accordance with the invention, generally stated, a base support for the supporting, positioning, and mounting of an antenna such as a satellite dish antenna, on a stationary upstanding member is provided having a worm gear assembly mounted to the stationary member. The worm gear assembly has a tubular outer main bearing having a worm gear at its first end and diametrically opposed support legs for mounting on the stationary member at its second end. A base member is rotatably attached to the worm gear assembly. An inner main bearing is mounted between the worm gear and the base member with one beating surface resting on the worm gear and a second bearing surface abutting the base member. An antenna support structure is integrally formed on the base member. A motor driven worm assembly is attached to base member having a rotatable worm in tight intermeshing contact with the worm gear. A stepping motor, driven by a stepping motor driver drives the worm. The stepping motor driver is controlled by an externally supplied power source and control which can be a simple battery and switch or a complex microprocessor. The motor, the worm assembly, the base member and the associated antenna support are all movable in a generally horizontal plane about the vertical axis worm gear assembly upon operation of the stepping motor. In an alternative embodiment, a second worm gear assembly and a second driven motor driven worm assembly are mounted transverse to the first such assemblies, between those assemblies and the antenna support structure, so as to move the associated antenna in a generally vertical plane about the horizontal axis of second worm gear assembly upon operation of the second stepping motor. In another embodiment backlash between the worm and worm gear is eliminated by locking the ball bearing in the output of the gear shaft on which the worm is mounted.

DETAILED DESCRIPTION OF THE PREFERRED EMBODIMENT

Figure 1:
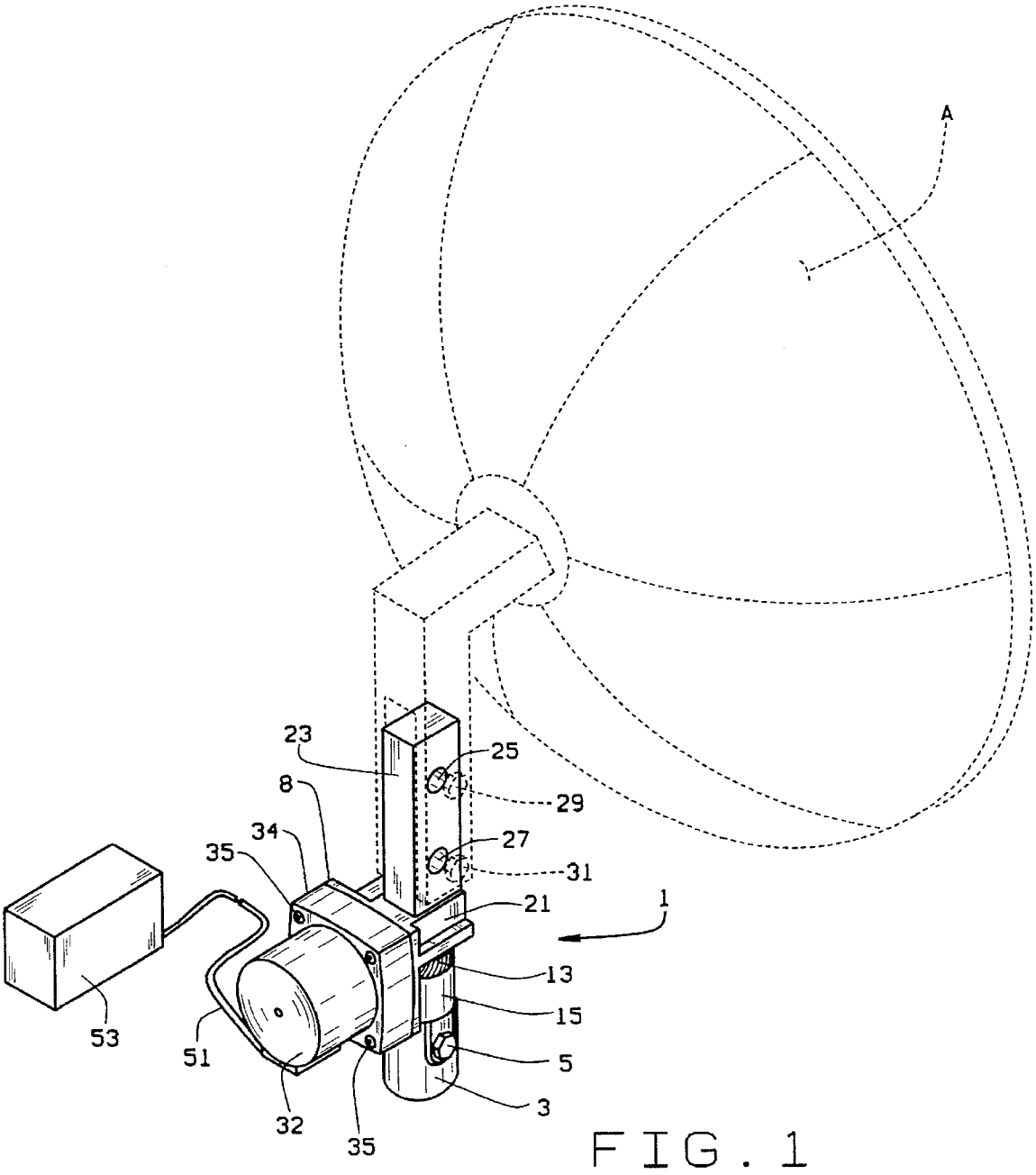
FIG. 1 is a perspective view of the antenna base support of the present invention having an antenna, shown in phantom, mounted thereon.

With reference to the drawings, and, FIG. 1 in particular, there is shown a base support for a dish antenna, or the like, generally referred to by reference numeral 1, constructed in accordance with the principles of the present invention. Support 1 is shown supporting a dish antenna A. The elements of base support 1 will be described in greater detail hereinafter.

Base support 1 is generally attached to an stationary upright member or extension 3. It should be noted that upright 3 can be formed of in any appropriate configuration or of any appropriate material, such as tubular steel, and in any appropriate design. Furthermore, extension 3 may be an extension of or is connected to an appropriate platform, brace, bracket, or the like, to facilitate the mounting of the antenna base support of the present invention on a surface, such as on the roof of a vehicle, in the case of a mobile antenna. The mounting means and the stationary upright do not form part of the invention, as claimed.

Support 1 is secured to upright 3 by means of a nut and bolt assembly 5 or other appropriate means. The elements of support 1 may be protected from the weather, dirt, and debris by an appropriate shroud or plastic cover (not shown) which surrounds the working elements of support 1.

Figure 2:
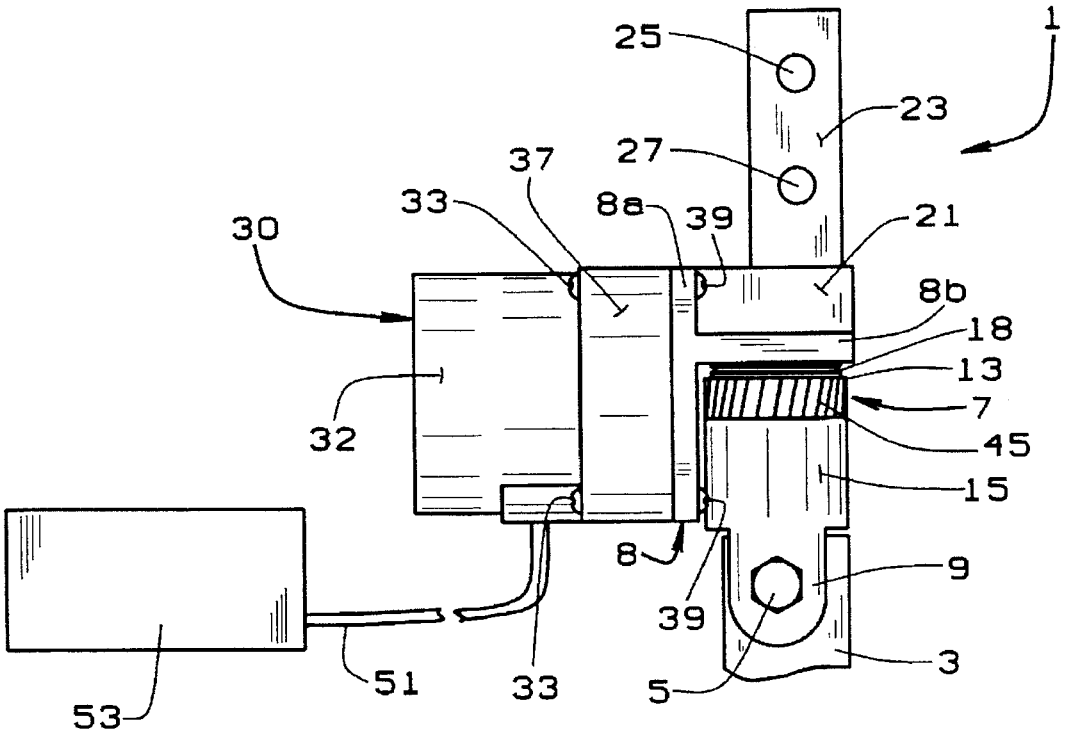
FIG. 2 is a front elevational view of the antenna base support of the present invention.
Figure 3:
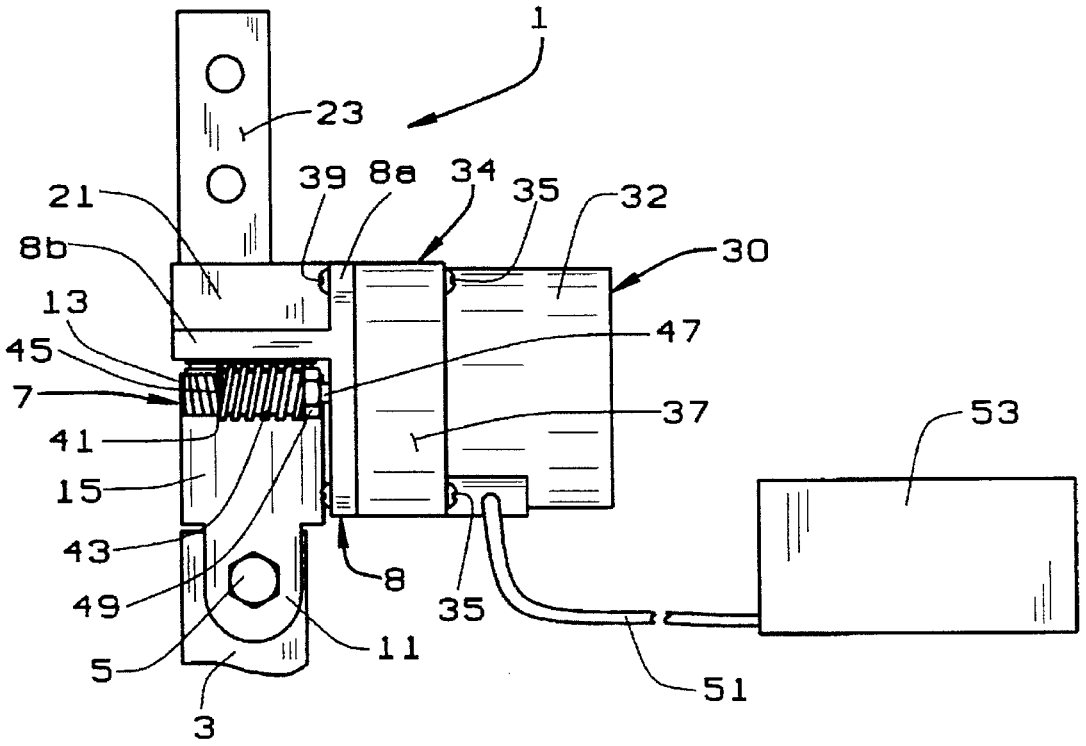
FIG. 3 is a rear elevational view of the antenna base support of the present invention.

Support 1 is shown in greater detail in FIGS. 2 and 3. Adjacent upright support 3 is a worm gear assembly 7. Worm gear assembly 7, includes a generally horizontally disposed worm gear, 13. Outer main bearing 15 has an axial bore formed therethrough for the insertion of a shaft (not shown) to attach the worm gear assembly to a base member 8. Base member 8 has a generally "T" configuration and is formed from a vertically positioned web **8*a* and a horizontally positioned web 8*b*. As previously described, support legs 9 and 11 are integrally formed and extend from the lower end of main bearing 15. Gear 13 is integrally formed from the opposite end of bearing 15. Worm gear assembly 7** can be constructed from a resilient material, such as nylon, or it can be formed from metal or other appropriate material.

An annular inner main bearing 18 is positioned between worm gear 13 and the bottom surface of web **8*b*, with one bearing surface of inner bearing 18 abutting worm gear 13 and the opposite bearing surface abutting web 8*b*. A boss 21 is integrally formed on the top surface of web 8*b* diametrically opposed to inner bearing 18. Antenna support 23 is integrally formed on and extends from boss 21. Antenna support 23 has holes 25 and 27 formed therethrough for the attachment of antenna A with bolts 29 and 31 are with other appropriate attachment means. It should be noted that base 8, including webs 8*a* and 8*b*, boss 21 and antenna support 23** may be formed as one piece from cast metal or other appropriate material. Alternatively, the various elements just described can be separate elements suitably attached together as if formed in one piece.

A motor driven worm assembly, shown generally as 30, is attached to a side of web **8*a* opposite worm gear assembly 7. Worm assembly 30 has a stepping motor 32 operatively associated with and mounted to a gear transmission assembly 34 with mounting screws 35. A conventional gear train (not shown) is contained within a gear case 37 and is available in various stepping motor gear reduction ratios depending upon the application. Case 37 is attached to web 8*a* with screws 39** or other appropriate attachment means.

A generally cylindrically worm 41, having a continuous helical tooth 43, is in intermeshing contact with adjacent ones of the radially outwardly directed teeth 45 which are positioned 360° circumferentially around worm gear 13. Worm 41 is mounted for rotation about its horizontal axis on a shaft 47 which operatively connected to, and protrudes from, gear assembly 34 through web **8*a*. Worm 41 which is secured in place by a hex nut 49 or other appropriate means. Worm 41 may be driven in either direction of rotation by a reversible stepping motor 32 through transmission 34**.

Motor 32 is connected by electrically conductive wire 51 to a stepping motor driver 53. It should be noted that wire 51 is shown connected directly to motor 32 and exposed for illustrative purposes only. Wire 51 may be suitably connected to motor 32 in any conventional or accepted manner that would allow assembly 1 to rotate about a vertical axis without tangling or binding wire 51. For example, wire 51 may be housed with an upright 3 and connected with a conventional slip ring electrical connector or any other suitable arrangement. Moreover, the antenna A lead wire (not shown) should be suitably placed and arranged so as to avoid problems of winding or tangling.

In operation, base support 1 is used to scan in a generally horizontal plane around the vertical axis of worm gear 13. The stepping motor driver 53 is activated to operate motor 32. Motor 32 drives gear transmission 34 which is operatively attached to shaft 47 of worm 13 to rotate helical tooth 45 about the horizontal axis of shaft 47 in a desired rotational direction. Inasmuch as worm gear 13 and outer main bearing 15 are held in place by legs 9 and 11, rotation of worm tooth 45 will cause worm 41 to revolve, along with base 8 and worm assembly 30, and antenna support 23. Web 8*b* will rotate on a beating surface of inner bearing 18 which is free to rotate on the surface of worm gear 13. The surfaces between worm gear 13 and inner bearing 18, as well as between web 8*b* and inner bearing 18, are sufficiently smooth and lubricated to provide smooth movement of the base 8, as well as the parts mounted thereon, relative to worm gear 13, about the vertical axes of inner and outer bearing members. When motor 32 is stopped, worm 41 will not rotate, thus providing a locked positioning of antenna support 23 and, thus, antenna A.

Since it is advantageous to change the horizontal positioning of antenna A in fine increments, corresponding to the location of particular satellite or signals, support 1 employees a stepping motor 32 and driver 53. Driver 53 actuates motor 32 by sending voltage pulses to motor 32. Motor 32 will move in any fixed amount of rotational degrees, by driving worm 41, depending upon the design of motor 32. For example, the motor may be designed to drive worm 41 so that the worm assembly 30, base 8, and thus antenna A move 1° per pulse, 7½° per pulse, or 15° per pulse at the motor shaft through the reduction ratio depending upon the application. A 600:1 reduction ratio provides 0.012° movement at the antenna for a 7½° design motor. Moreover, the speed of rotation is dependent upon the rate that pulses are sent from driver 53 to motor 32. For example, at one degree per pulse, motor 32 requires 360 pulses to rotate one complete rotation about worm gear 13. Therefore, motor 32, as well as base 8 and the various attached elements, can move in very fine increments of one degree or one pulse at a time. The rate of rotation can be increased or decreased by increasing or decreasing the rate of pulses sent from the driver to the motor.

Figure 4:
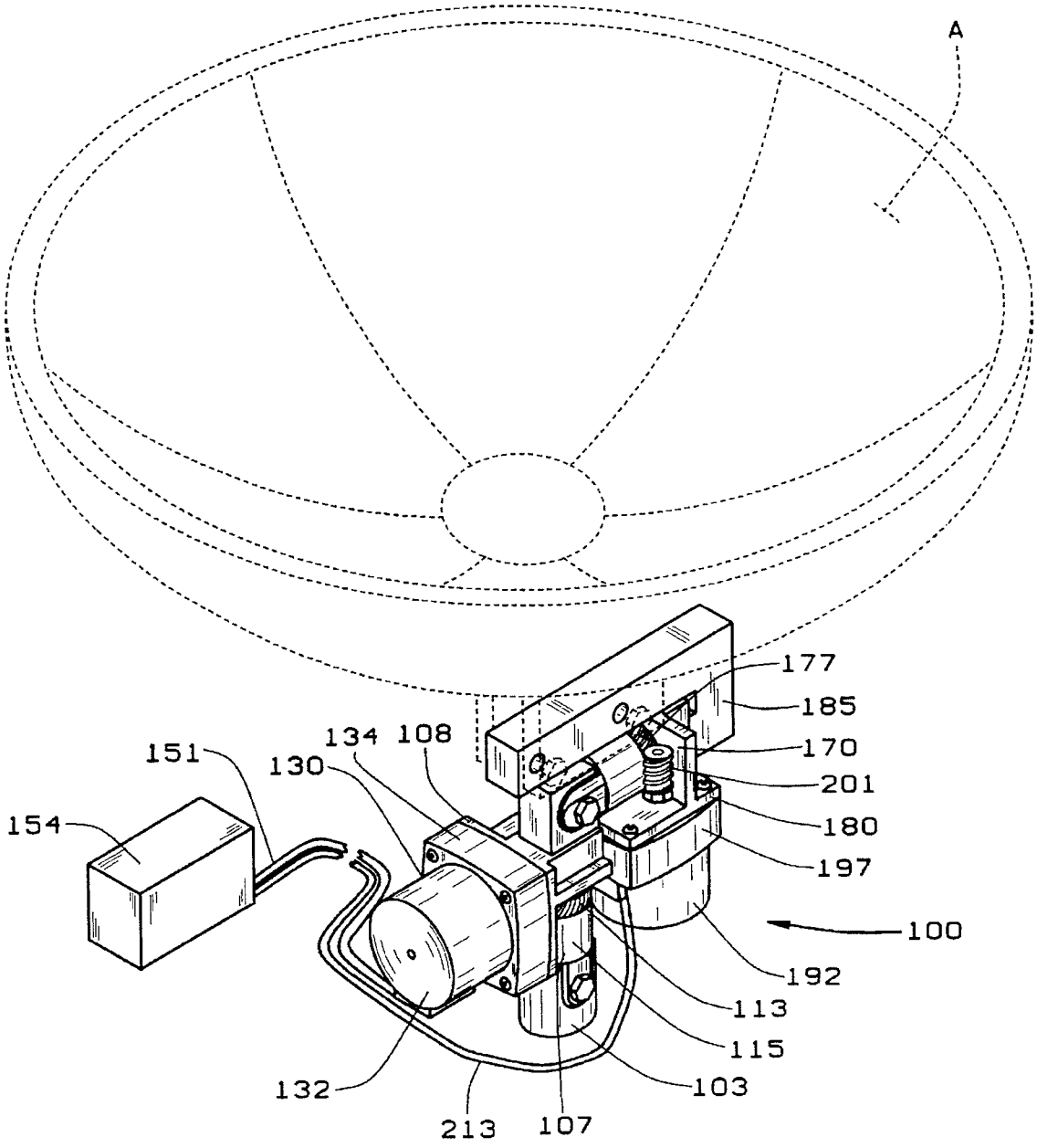
FIG. 4 is a perspective view of an alternative embodiment of the antenna base support of the present invention having an antenna, shown in phantom, mounted thereon.
Figure 5:
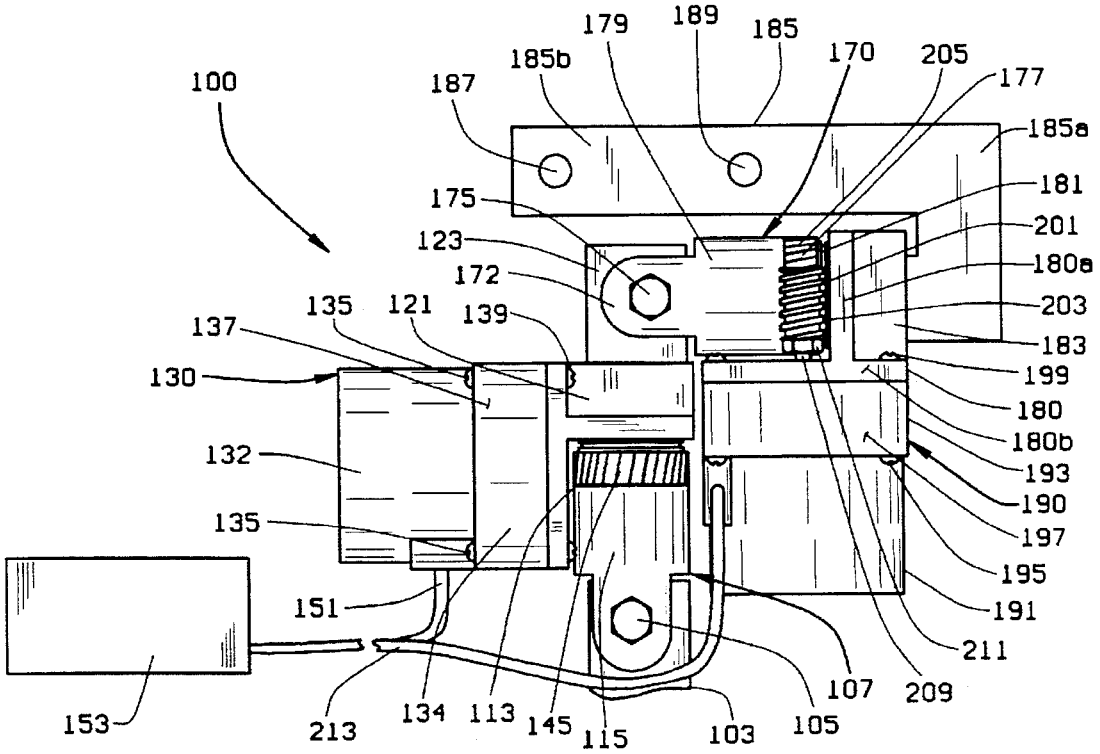
FIG. 5 is a front elevational view of the antenna base support as illustrated in FIG. 4.
Figure 6:
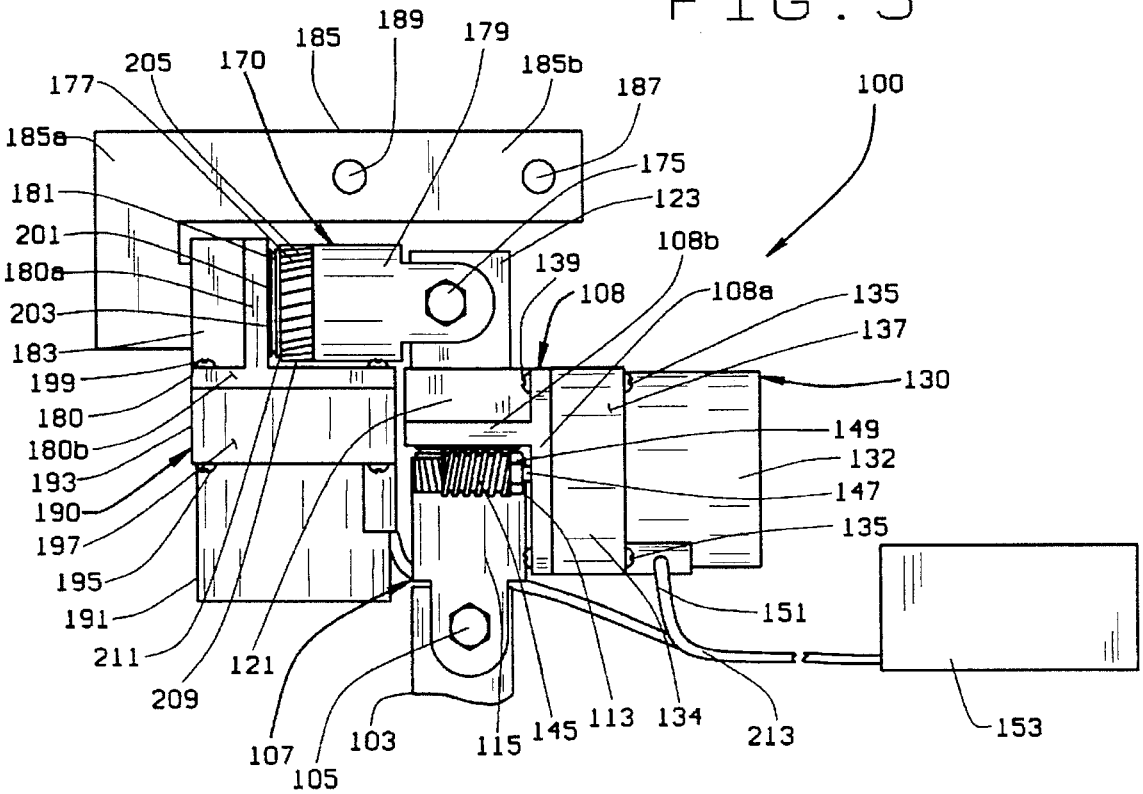
FIG. 6 is a rear elevational view of the antenna base support as shown in FIG. 4.

FIGS. 4–6 illustrate another preferred embodiment of the base support of the present invention, indicated generally by numeral 100. Support 100 is generally attached to a stationary upright 103. Upright 103 may of any appropriate configuration, as previously explained, and of any appropriate materials such as tubular steel, and is connected to, or an integral part of, a platform, brace or bracket (not shown) used to mount the antenna on a surface, such as the roof of a vehicle. Support 100 is secured to the upright 103 by means of a nut and bolt assembly 105 or other appropriate means. Support 100 may be protected from the weather, dirt or debris by an appropriate shroud or molded plastic cover, (not shown). Adjacent support 103 is a first worm gear assembly 107 having diametrically opposed support legs 109 and 111 which are attached to upright 103 by nut and bolt assembly 105 as previously described. Worm gear assembly 107 also includes a generally horizontally disposed worm gear 113 and an upstanding, tubular outer main bearing 115. Main bearing 115 has an axial bore, (not shown) formed therein. A shaft (not shown) extends through the axial bore of bearing 115 to attach worm gear assembly 107 to a first base member 108. Base member 108 has a generally "T" configuration formed from a vertical web 108*a* and horizontal web 108*b*. An annular inner main bearing 118 is positioned between the top surface of worm gear 113 and the bottom surface of web 108*b*, with one bearing surface abutting worm gear 113 and the opposite bearing surface of abutting web 108*b*.

A boss 121 is integrally formed on the top surface of web 108*b* on a side opposite inner bearing 118. A second worm gear assembly support 123 is integrally formed on and extends from boss 121 for the attachment of a second worm gear assembly as will be described in detail below. It should be noted that base 108, including webs 108*a* and 108*b*, boss 121, and second worm gear assembly support 123 may be formed as one piece from cast metal or other appropriate material or may be assembled from the various independent elements and appropriately joined together.

A first motor driven worm assembly, shown generally at 130, is attached to a side of web 108*a*, opposite worm gear assembly 107. Worm assembly 130 has a stepping motor 132 operatively associated with and mounted to a gear transmission assembly 134 with mounting screws 135. A conventional gear train (not shown) is contained within a gear case 137, and is commercially available in appropriate gear ratios. Case 137 is attached to web 108*a* with screws 139 or other appropriate attachment means.

A first cylindrical worm 141, having a continuous helical tooth 143, is in intermeshing contact with adjacent ones of the radially outwardly directed teeth 145 which are positioned 360° circumferentially around worm gear 113. Worm 141 is mounted for rotation about a horizontal axis on shaft 147, which is operatively associated with, and protrudes from, gear assembly 131 through web 108*a*. Worm 141 and is secured in place by hex nut 149. Worm 141 may be driven in either direction of rotation by reversible stepping motor 132, through gear transmission 134. Motor 132 is connected by electrically conductive wire 151 to a stepping motor driver 153. As stated above, with reference to assembly 1, wire 151 is shown connected directly to motor 32 and exposed for illustrative purposes only. Wire 151 may be suitably connected to the motor and may be maintained within upright 3 so as to avoid exposure and entanglement about the assembly 100 when in use.

Adjacent second worm gear support 123 is a second worm gear assembly 170, having diametrically opposed support legs 172 and 173 which are mounted to second worm gear support 123 with a nut and bolt assembly 175. Second worm gear assembly 170 includes a vertically disposed worm gear 177 and a horizontally disposed tubular outer main bearing 179. Main beating 179 has an axial bore (not shown) formed therethrough. A shaft (not shown) extends through the axial bore in bearing 179 so as to connect worm gear assembly 170 to a second base member 180. Second base member 180 has a generally "T" configuration formed from a vertical web 180*a* and a horizontal web 180*b*. An annular inner main beating 181 is positioned between the outer surface of worm gear 177 and the inner surface of web 180*a*, with one beating surface abutting worm gear 177 and the opposite bearing surface abutting web 108*a*.

A boss 183 is formed on the outer surface of web 108*a*, opposite inner bearing 181. An antenna support arm 185 is integrally formed on and extends from a boss 183 for the attachment of antenna A. Support arm 185 has a generally vertical section 185*a* and a horizontal section 185*b* integrally connected to the vertical section. Mounting holes 187 and 189 are formed through horizontal section 185*b* for the attachment of an antenna in any appropriate manner. It should be noted that base 180, including webs 180*a* and 180*b*, boss 183 and support arm 185 may be formed from one piece of cast metal or other appropriate material or may be assembled from the various independent element previous described and appropriately joined together.

A second motor driven worm assembly, shown generally at 190, is attached to a bottom side of 180*b*, opposite worm gear assembly 170. Worm assembly 190 has a stepping motor 191 operatively associated with and mounted to a gear transmission assembly 193 with mounting screws 195. A conventional gear train (not shown) is contained within housing 197 and is of the type commercially available in appropriate gear ratios as previously described with reference to assembly 1. Housing 197 is attached to web 108*b* with screws 199 or on the appropriate attachment means. A second cylindrical worm 201 having a continuous helical tooth 203 is in intermeshing contact with adjacent ones of outwardly directed teeth 205 which are positioned 360° circumferentially about worm gear 177.

Worm 201 is mounted for rotation about its horizontal axis on shaft 209 and is secured in place by hex nut 211. Shaft 209 extends through web 180*b* and is operatively associated with the gear train (not shown) within gear transmission 193. Worm 201 is thus driven in either direction by stepping motor 191 which is connected by an electrically conductive wire 213 to a stepping motor driver 153 or a separate stepping motor driver (not shown). It should be noted, that electrical wire 213 is shown, for illustrative purposes, connected directly between stepping motor 191 and stepping motor driver 153. However, as previously explained, the wire may be suitably connected and housed within tubular upright 103 or otherwise appropriately maintained to avoid entanglement with the elements of the support.

In operation, base support 100 is used to scan in both a generally horizontal plane and a generally vertical plane. The antenna A will scan in a generally horizontal plane around the vertical axis of worm gear 113 and in a generally vertical plane around the horizontal axis of worm gear 177. For scanning in a generally horizontal plane, stepping motor driver 153 is activated to operate motor 132. Motor 132 drives gear transmission 134 which is operatively attached to shaft 147 of worm 113 to rotate helical tooth 145 about the horizontal axis of shaft 147 in a desired rotational direction. Inasmuch as worm gear 113 and outer main bearing 115 are held in place by legs 109 and 111, rotation of worm tooth 145 will cause the worm assembly to revolve, along with base 108 and worm assembly 130, antenna support 120 and second worm gear assembly support 123, about worm gear 113. Web 108*b* will rotate on bearing surface of inner bearing 118, which is free to rotate on the surface of worm gear 113. The surfaces between worm gear and inner bearing 118, as well as web 108*b* and inner bearing 118, are sufficiently smooth and lubricated to provide smooth movement of base 108 as well as the parts mounted thereon, relative to worm gear 113 about the vertical axis of the worm gear assembly 107. When the motor is stopped, worm 141 will not rotate, thus providing a locked positioning of the antenna in a desired horizontal position.

Since it is advantageous to change the horizontal positioning of the antenna A in fine increments, corresponding to the location of a particular satellite signals, base support 100 employs a stepping motor 132 and driver 153. Stepping motor 131 will move in fixed amounts of rotational degrees depending upon the design of motor 132 and the pulses sent to motor 131 by stepping motor driver 153 as previously described relative to base assembly 1.

To scan in a generally vertical plane about the axis of worm gear 177, stepping motor driver 153 is operated to activate motor 191. Motor 191 drives gear transmission 193 which is operatively attached to shaft 209 of worm 201 to rotate helical tooth 203 about the vertical axis of shaft 209 in a desired rotational direction. Since worm gear 177 and outer main bearing 179 are held in place by legs 172 and 173, the rotation of worm tooth 203 will cause worm 201 to rotate, along with base 180, worm assembly 190, and antenna support arm 185 with its associated antenna. Web 180*b* will rotate on the bearing surface of inner bearing 181, which is free to rotate on the surface of worm gear 177. The surfaces between worm gear 177 and inner bearing 181, as well as between web 180*a* and inner bearing 181 are sufficiently smooth and lubricated to provide smooth movement of the base, as well as the parts thereon, relative to worm 177, about the horizontal axis of the worm gear assembly 170. When motor 191 is stopped, worm 201 will not rotate, thereby providing a locked positioning of the antenna support 185 and the antenna in the desired vertical position. Stepping motor 191 and the stepping motor driver 153, operate in the same manner as the previously described stepping motors and stepping motor controllers to move antenna A in a vertical plane in fine incremental movements. The rate of movement is dependent upon the pulses sent by driver 153 to stepping motor 191.

Figure 7:
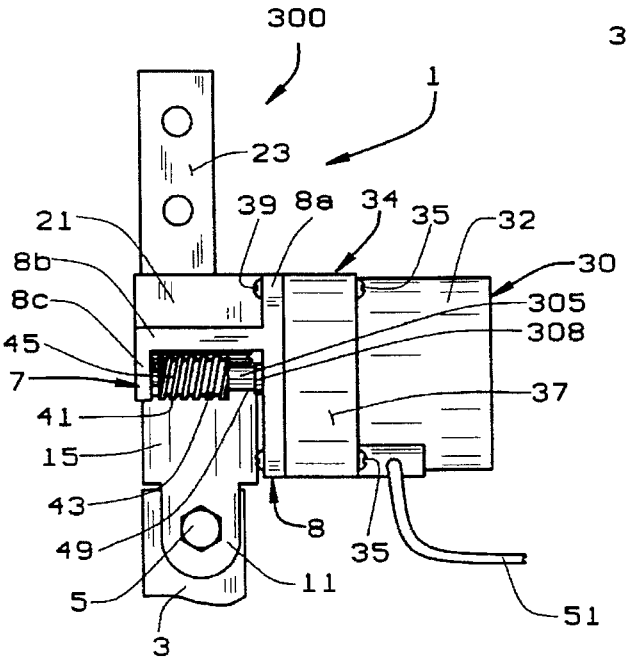
FIG. 7 is a front elevational view of another embodiment of an antenna base support of the present invention.
Figure 8:
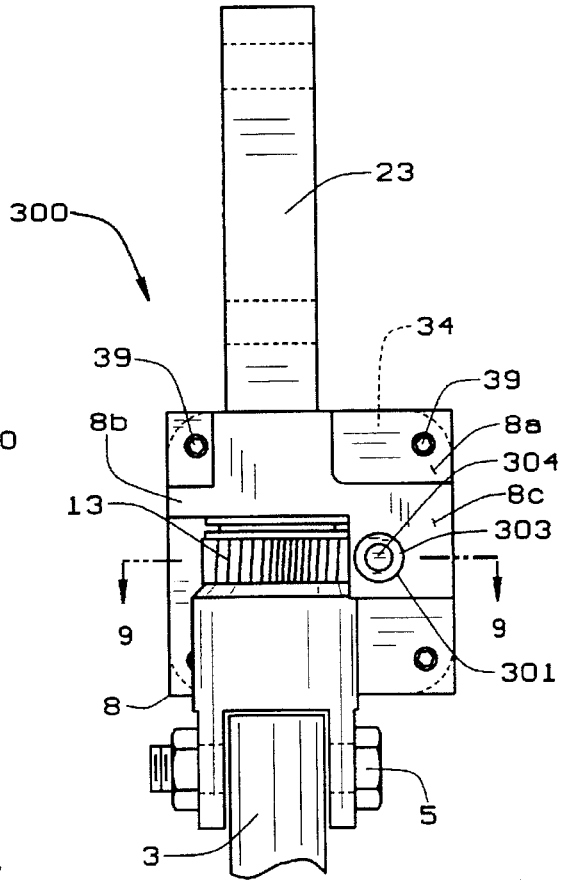
FIG. 8 is a side elevational view of the antenna base support of FIG. 7.
Figure 9:
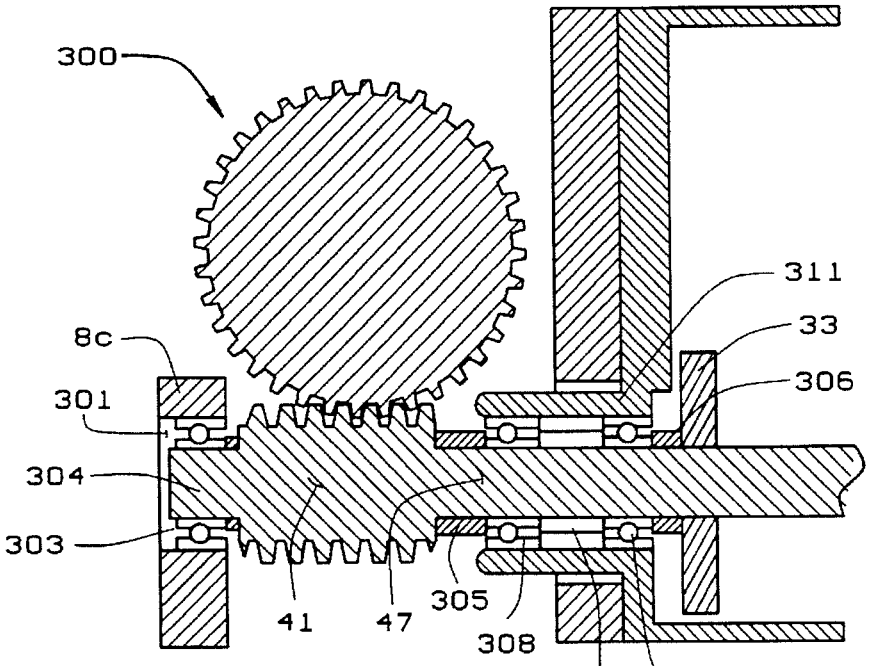
FIG. 9 is a cross-sectional view of the antenna base support taken along 9—9 of FIG. 8.

FIGS. 7–9 illustrate another embodiment of the antenna support of the present invention. The antenna support of FIGS. 7–9, indicated generally by reference numeral 300, is identical to the support as shown and described in FIGS. 1–3 with notable exceptions. There is a worm support web 8*c* integrally formed on horizontally positioned web 8*b*. Support web 8*c* is generally square and perpendicular to web 8*b*. There is a circular opening 301 formed in support web 8*c*. A first or outboard ball bearing race 303 is press fitted into opening 301. As stated above, worm 41 is mounted on shaft 47. An end 304 of the shaft 47 seats snugly in bearing 303 so that there is no lateral movement of worm 304 away from worm gear 13. As best seen in FIG. 9, there is a first spacer 305 and second spacer 306 slip fit on shaft 47. First spacer 305 is positioned approximately at a midpoint of shaft 47, adjacent worm 41. The second spacer 306 is at an end of shaft 47 adjacent the drive gear 33. There is a second ball bearing race 308 and third ball beating race 309 press fitted in gear housing 311 with the second race 308 pressed firmly against shoulder 312 of the housing 311. Spacer 305 presets the distance between worm 41 and second ball bearing race 308. During assembly, spacer 306 is slip fit over shaft 306. The second ball bearing race 308 and third ball bearing race 309 are press fitted into the gear housing 311. The shaft 47, with spacer 306 thereon, is slipped through the second and third ball bearing races. With the gear side held firm, spacer 305 is press fitted on shaft 47. Shaft 47 is positioned so that spacer 305 is snug against the second ball bearing race 308 so that there is no axial free play along shaft 47. The worm 41 is now placed on shaft 47 and abuts spacer 305 and held there supporting spacer 305 so axial movement, for practical purposes, does not occur. Housing 311 will now support the worm drive. First ball bearing race 303 is now placed on end 304 of shaft 47. Outboard bearing race 303 is press fitted into the support web 8*c*. The gear case 37 is attached with screws 39 (FIG. 8). Motor 32 is now positioned to move the worm 41 into proper alignment with the worm gear 13.

Figure 10:
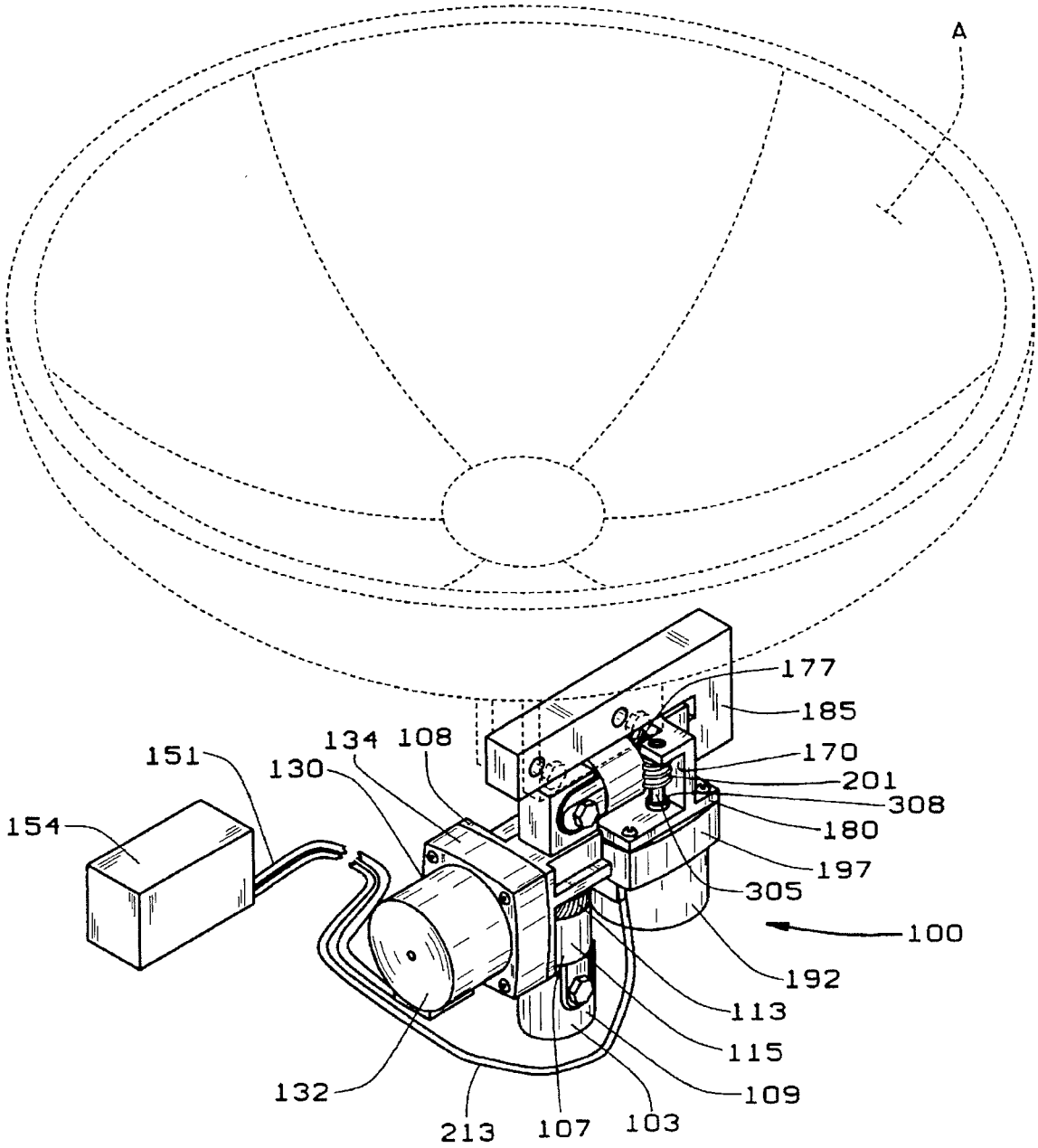
FIG. 10 is a perspective of another alternative embodiment of the antenna base support of the present invention having an antenna, shown in phantom, mounted thereon.
Figure 11:
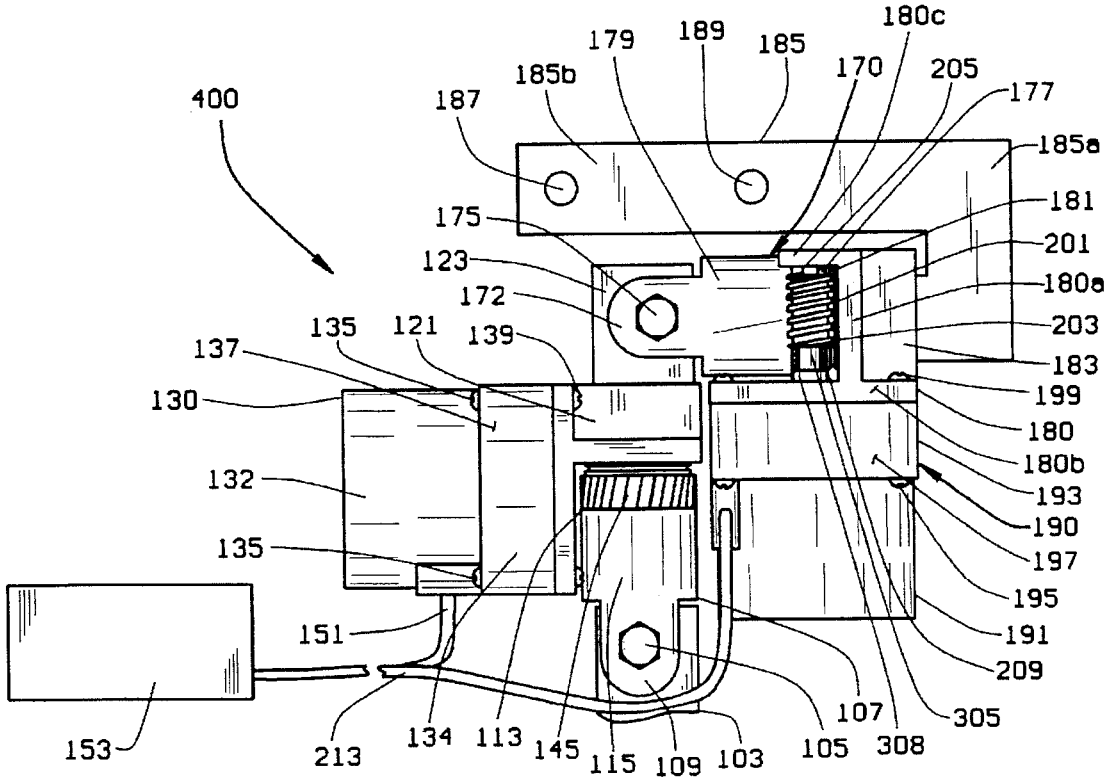
FIG. 11 is a front elevational view of the antenna base support as illustrated in FIG. 10.
Figure 12:
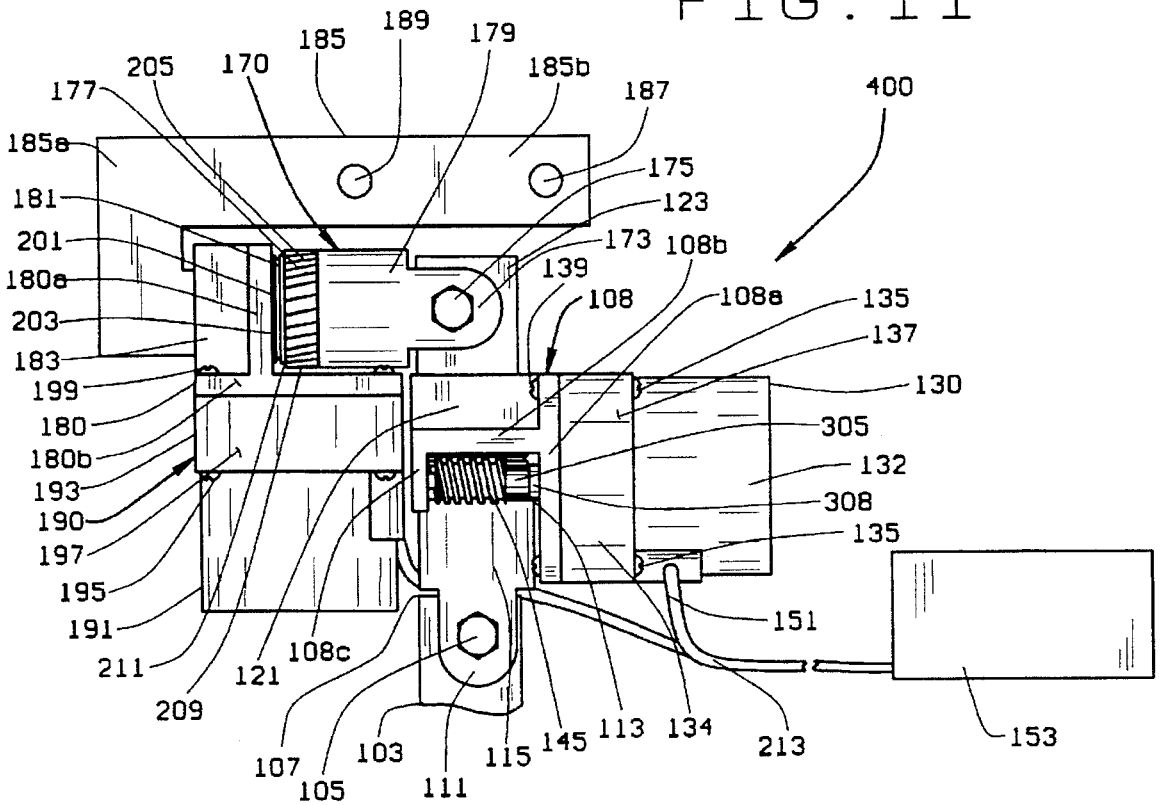
FIG. 12 is a rear elevational view of the antenna base support as shown in FIG. 10.

FIGS. 10–12 illustrate yet another embodiment of the antenna base support of the present invention. The support, indicated generally be reference numeral 400, is identical in structure to support 100 shown in FIGS. 4–6 with some notable exceptions. Support 400 has a first worm support web 108*c* perpendicular to web 108*b*. Furthermore, support 400 has a second worm support web 180*c* perpendicular to horizontal web 180*b*. The support webs 108*b* and 180*b* are assembled and function the same as support web 8*c* previously described in reference to support 300 in FIGS. 7–9. First cylindrical worm 141 is supported by a first or outboard ball bearing race 303 and second cylindrical worm 201 is supported by a first or outboard ball bearing race 303. The respective outboard ball bearing races are assembled and function the same as outboard ball bearing race 303 previously described relative to support 300, as illustrated in FIG. 9 Furthermore, a cross-section of the first motor driven worm assembly 130 and a cross-section of the second motor driven worm assembly 190 is identical to the cross-section shown in FIG. 7. Each of the respective motor driven worm assemblies employ the spacers 305 and 306, as well as the second and third ball bearing races 308 and 309 previously described with reference to support 300. The unique arrangement of the worm support webs, outboard ball bearing races, second and third bearing races prevent both axial and radial movement of the respective cylindrical worms relative to the respective worm gears.

It will obvious to the those skilled in the art that various modifications and changes can be made in the antenna base supports previously described and illustrated without departing from the scope of the appended claims. Therefore, the detailed description and accompanying illustrations are intended to be illustrated only, and should not be construed in a limiting sense.

I claim:

1. A base support for supporting, positioning and maintaining a desired positions of an antenna mounted on a stationary upright comprising;

first stationary worm gear assembly having a tubular outer main bearing having first and second ends, a first worm gear on one of said first and second ends and a pair of opposed support legs on the other of said first and second ends for mounting said first worm gear assembly to a stationary upright;

a first base member rotatably attached to said first stationary worm gear assembly;

an inner main bearing between said first base member and first stationary worm gear assembly, said inner main bearing having a first bearing surface and a second bearing surface, said first bearing surface resting on said tubular outer main bearing and said second bearing surface abutting said first base member;

a worm gear assembly support means attached to said first base member;

a first motor driven worm assembly mounted on said first base member, said first motor driven worm assembly including a worm operatively connected to the worm gear of said first stationary worm gear assembly, said first motor driven worm assembly including a first stepping motor for driving said worm or said first motor driven worm assembly, said worm being mounted in tight intermeshing contact with the worm gear of said first stationary worm gear assembly, said worm having a bearing assembly at a first end, a second bearing assembly adjacent a midpoint of said worm and a third bearing assembly adjacent said stepping motor, said bearing assemblies disposed to prevent backlash between said worm and said first worm gear;

said first stepping motor, said first motor driven worm assembly, said first base member, and said worm gear assembly support means all being movable about the vertical axis of said first stationary worm gear assembly upon operation of said stepping motor;

a second stationary worm gear assembly mounted on said worm gear assembly support, said second stationary worm gear assembly having a tubular outer main bearing having first and second ends, a second worm gear on one of said ends, and a second pair of opposed support legs on the other of said first and second ends for mounting said second stationary worm gear assembly to said worm gear assembly support means;

a second base member rotatably attached to said second stationary worm gear assembly;

a second inner main bearing member between said second stationary worm gear assembly and said second base member having a first bearing surface and a second bearing surface, said first bearing surface resting on said second worm gear and said second bearing surface abutting said second base member;

antenna support means attached to said second base member;

a second motor driven worm assembly mounted on said second base member, said second motor driven worm assembly including a second worm operatively connected to the worm gear of said second worm gear assembly, said second motor driven worm assembly including a second stepping motor for driving the worm of the second motor driven worm assembly, said worm being mounted in tight intermeshing contact with the worm gear of said second stationary worm gear assembly, said second worm having a bearing assembly at a first end, a second bearing assembly adjacent a midpoint of said worm and a third bearing assembly adjacent said stepping motor, said bearing assemblies disposed to prevent backlash between said worm and said second worm gear;

said second stepping motor, said second motor driven worm assembly, said second base member and said antenna support means all being movable about a horizontal axis of said second stationary worm gear assembly upon operation of said second stepping motor.

2. The base support of claim 1 wherein each said stepping motor is driven by a stepping motor driver.

3. The base support of claim 2 wherein said stepping motor driver sends a voltage pulse to each said stepping motor, said motor moving in a fixed amount of rotational degrees depending upon a preset amount of rotational degrees per pulse.

4. The base support of claim 3 wherein a speed of rotation of each said motor is dependent upon the rate of pulses sent by said driver to each said motor.

* * * * *